US010660462B2

(12) United States Patent
Grinstead

(10) Patent No.: US 10,660,462 B2
(45) Date of Patent: May 26, 2020

(54) TWO-SIDED PILLOW

(71) Applicant: MerchSource, LLC, Irvine, CA (US)

(72) Inventor: Jolene Grinstead, Brea, CA (US)

(73) Assignee: MerchSource, LLC, Irvine, CA (US)

( * ) Notice: Subject to any disclaimer, the term of this patent is extended or adjusted under 35 U.S.C. 154(b) by 10 days.

(21) Appl. No.: 15/807,171

(22) Filed: Nov. 8, 2017

(65) Prior Publication Data

US 2018/0213954 A1 Aug. 2, 2018

Related U.S. Application Data

(60) Provisional application No. 62/453,399, filed on Feb. 1, 2017.

(51) Int. Cl.
*A47G 9/10* (2006.01)

(52) U.S. Cl.
CPC ..... *A47G 9/1036* (2013.01); *A47G 9/10* (2013.01); *A47G 2009/1018* (2013.01)

(58) Field of Classification Search
CPC ..... A47G 9/10; A47G 9/1036; A47G 2009/1018; A47C 17/15; A47C 27/148; A47C 27/142; A47C 27/144; A47C 27/146
USPC ..... D6/601
See application file for complete search history.

(56) References Cited

U.S. PATENT DOCUMENTS 3,239,854 A * 3/1966 Freedlander ..... A47C 27/144 5/636
3,323,152 A * 6/1967 Lerman ..... A47C 27/144 297/452.43
3,443,267 A * 5/1969 Schuckman ..... A47G 9/10 5/645
4,799,275 A 1/1989 Sprague, Jr.
5,537,703 A 7/1996 Launder et al.
5,884,351 A 3/1999 Torino
6,668,404 B2 12/2003 Lanteri
D507,142 S 7/2005 Akamatsu et al.
7,051,389 B2 5/2006 Wassilefky
7,415,742 B2 8/2008 Wassilefky
7,530,127 B2 5/2009 Leifermann et al.
(Continued)

FOREIGN PATENT DOCUMENTS

GB 1046049 A * 10/1966 ..... A47C 27/144
GB 2235130 * 2/1991
(Continued)

OTHER PUBLICATIONS

Amerisleep. Compare our Mattresses. Mar. 10, 2015. https://www.amerisleep.com/memory-foam-buying-guide. (Year: 2015).*

*Primary Examiner* — Nicholas F Polito
*Assistant Examiner* — Amanda L Bailey
(74) *Attorney, Agent, or Firm* — Avyno Law P.C.

(57) ABSTRACT

A pillow comprising two sections of generally equal size made of pillow material, each section with a different firmness, where one section forms an upper half of the pillow and the other section forms the lower half of the pillow. Each section has a domed top and a bottom, where the bottoms of each section are joined together. The pillow may include holes extending through or at least partially through the pillow. The two joined sections may further be covered by the covering having a top layer and bottom layer joined together by a gusset.

22 Claims, 6 Drawing Sheets

(56) References Cited

U.S. PATENT DOCUMENTS

| | | | | |
|---|---|---|---|---|
| 7,735,169 | B2 | 6/2010 | Wassilefky | |
| 8,015,640 | B2 | 9/2011 | Sun | |
| D677,506 | S | 3/2013 | Lai | |
| 8,607,391 | B2 | 12/2013 | Poppe | |
| 8,656,537 | B2 | 2/2014 | Leifermann et al. | |
| 9,138,084 | B1 * | 9/2015 | Namolovan | A47G 9/007 |
| 9,462,902 | B1 * | 10/2016 | Rukel | A47G 9/10 |
| 2002/0088057 | A1 * | 7/2002 | Wassilefsky | A47C 20/021 5/648 |
| 2004/0237206 | A1 * | 12/2004 | Webster | A47C 21/046 5/727 |
| 2005/0257320 | A1 | 11/2005 | Mollett | |
| 2005/0278852 | A1 | 12/2005 | Wahrmund et al. | |
| 2006/0064819 | A1 | 3/2006 | Mollett | |
| 2009/0083908 | A1 * | 4/2009 | Fry | A47G 9/0253 5/636 |
| 2011/0061167 | A1 | 3/2011 | Farley | |
| 2011/0094033 | A1 * | 4/2011 | Lee | A61F 5/56 5/636 |
| 2012/0102654 | A1 * | 5/2012 | Lee | A47G 9/0253 5/645 |
| 2012/0204350 | A1 | 8/2012 | Katsnelson | |
| 2013/0014328 | A1 * | 1/2013 | Requet | A47G 9/109 5/640 |
| 2013/0098364 | A1 * | 4/2013 | Davis | A47G 9/1081 128/206.21 |
| 2013/0263377 | A1 | 10/2013 | Wootten, Jr. | |
| 2013/0291306 | A1 | 11/2013 | Willingham | |
| 2014/0008036 | A1 * | 1/2014 | Segal | A47C 7/746 165/46 |
| 2014/0053336 | A1 | 2/2014 | Cai | |
| 2014/0283305 | A1 | 9/2014 | Zysman | |

FOREIGN PATENT DOCUMENTS

| | | | |
|---|---|---|---|
| WO | 2010075296 | A1 | 7/2010 |
| WO | 2011141943 | A1 | 11/2011 |

* cited by examiner

TWO-SIDED PILLOW

CROSS REFERENCE TO RELATED APPLICATIONS

The application claims priority to U.S. Provisional Patent Application No. 62/453,399, filed on Feb. 1, 2017, titled Two Sided Memory Foam Pillow, which application is incorporated into this application by reference in its entirety.

FIELD OF THE INVENTION

This invention relates to pillows, and specifically to pillows having a plurality of zones formed from pillow materials having different firmness levels.

BACKGROUND OF THE INVENTION

Pillows are an important piece of bedding that provide comfort and support for the head, neck and upper back. Having a supportive pillow helps ensure that an individual's neck rests in a neutral position while sleeping. This is important as it prevents muscle strain while sleeping: an individual needs this support when he or she is sleeping because the human spine is naturally curved. Having support for the head and neck helps to maintain the proper alignment of these areas of the spine. Sleeping without the adequate support not only has a negative impact on sleep, but it can also result in stiffness in the neck and back.

Having the right pillow is also key to a good night's sleep. Getting an adequate amount of sleep is an important factor for living a healthy life. Getting enough quality sleep requires the individual to have good sleeping conditions. One of the key factors toward getting the full benefits of time in bed is having a pillow that fills the needs of the user. The Great British Sleep Survey of 2012 showed that 67% of respondents rated bodily discomfort as the highest factor keeping them awake at night. Having the right pillow is thus critical for maintaining a sound sleep. Since pillows play an important role in sleep, they will have a considerable impact on an individual's quality of rest and overall well-being.

Many different types of pillows have been designed that use different materials in order to provide the user with a different feel, comfort level or health benefits. These include natural fill pillows (down, feathers or a combination of the two); synthetic fill pillows (which are filled with a man-made fill, customarily polyester; poly cluster fill pillows (which have a synthetic fill of polyester clusters coated with silicone to feel and move like down); foam pillows (which are made of solid pieces or chunks of foam); and memory foam pillows (which are made from a dense, sponge-like material that molds around a user's neck and head for extra support).

The relatively recent introduction of memory foam (which is polyurethane with additional chemicals increasing its viscosity and density, and sometimes referred to as viscoelastic foam or "VEF") has allowed the creation of pillows that take advantage of the "memory" and other properties of the memory foam. Memory foam pillows are especially suited for sleepers who prefer a firm pillow or have neck or spine issues; however, memory foam pillows tend to have less breathability and make the user hot. When the user removes his or her head from the pillow, the pillow returns to the original shape. This pillow typically reacts to the weight placed upon it and only passively supports the weight based on the thickness or density of the memory foam.

When a pillow made with a filler material is not in use, regardless of which material is chosen as the filler, it should remain in a fluffy state and should be able to provide the level of support needed by the user. However, when the user lays his head down on the body of the pillow made with a filler, the filler becomes compressed and/or can shift. The compressed area of filler is thinner, relatively speaking, than the area of filler that is not compressed, which has a higher density. This causes the pillow to be unable to provide close comfortable support between the user's head and the pillow. This means that after using the pillow for a long period of time, the user may experience discomfort caused by muscle stiffness.

A large number of pillows comprising multiple layers—vertical and/or horizontal—for therapeutically supporting the head and neck of a person lying in a supine position are known in the art. Representative examples are afforded by US 2014/0283305 (Zysman); US 2014/0053336 (Hong-Yuan Cal); US 2013/0291306 (Willingham, et al.); US 2013/0263377 (Wootten, Jr.); US 2012/0204350 (Katsnelson); U.S. 2006/0064819 (Mollett); U.S. 2005/0278852 (Wahrmund et al.); U.S. Pat. No. 8,656,537 (Leifermann, et al.); U.S. Pat. No. 8,607,391 (Poppe, et al.); U.S. Pat. No. 7,735,169 (Wassilefky, et al.); U.S. Pat. No. 8,015,640 (Xi Sun); U.S. Pat. No. 7,856,686 (Kwong Ming Cho); U.S. Pat. No. 7,530,127 (Leifermann); U.S. Pat. No. 7,415,742 (Wassilefky); U.S. Pat. No. 7,051,389 (Wassilefky); U.S. Pat. No. 4,777,855 (Cohen); U.S. Pat. No. 4,803,743 (Greenawalt); U.S. Pat. No. 5,307,532 (Connell); U.S. Pat. No. 5,638,564 (Greenawalt et al.); U.S. Pat. No. 5,689,844 (Liu); WO 2013/063644 (Poppe); US 2012/0102654 (Lee, et al.); WO 2011/141943 (Sciannameo); WO 2010/075296 (Mikkelsen, et al.); US 2006/0064819 (Mollett); US 2005/278852 (Wahrmund, et al.); WO 2005/085123 (Spinks); US 2005/0257320 (Mollett); U.S. Pat. No. 6,101,651 (Yee Keung Tang); U.S. Pat. No. 4,194,255 (Poppe); and U.S. Pat. No. 3,251,078 (Calla).

A need still exists for a pillow made of pillow material, including but not limited to regular foam, memory foam, or fill, that allows different firmness levels for the user, where the firmness levels span the length of the pillow. Further, breathable pillows are also desired to reduce the heat experienced by users.

SUMMARY OF THE INVENTION

The present application relates to a pillow comprising two sections of generally equal size made of pillow material, such as foam, which includes regular foam or memory foam and/or fill, each section with a different firmness, having a dome-like top and bottom that are joined together along their bottoms. The shape and thickness of the two sections are selected to provide optimal upper back, cervical and cranial support for the sleeper. Optionally, the pillow may include holes drilled through the pillow or portions of the pillow to allow the pillow to breathe and minimize the heat conducted by the user from the use of the pillow. Further, the pillow, either with or without the holes, may be enclosed in a gusseted covering.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

In general, the present application relates to a pillow having two sections (i.e., an upper/first and lower/second section) of generally equal size, each made from different or similar pillow material, which includes, but is not limited to, fill (i.e. any loose material, including but not limited to down, feathers, regular foam pieces, memory foam pieces, man-made fill, synthetic fill, poly cluster, or custom polyester), and/or foam, which may include regular foam (which is made of one piece or chunk of foam) or memory foam (which is made of one, dense, sponge-like material) or any combination thereof, of different or same densities, and each having a dome-shaped top and a bottom, which bottom may, in one example, be generally flat or may be contoured or undulating. The surface area of each of the bottoms is joined together, creating a central seam around the circumference of the pillow. The shape and thickness of the two sections are selected to provide optimal upper back, cervical and cranial support for the sleeper.

When using memory foam, the memory foam may further be constructed from polyurethane or viscoelastic foam. The memory foam may include charcoal infused into the foam for odor control. In one example, the memory foam may consist of 98% polyurethane foam and 2% charcoal. The charcoal may be derived from different biomasses. The pillow may include holes for allowing the pillow to breathe and may be encased in a gusseted pillow case. The gusset may be designed to not allow air to penetrate through, forcing all air running through the pillow to move through the top and bottom of the pillow, rather than through the sides.

Figure 1:
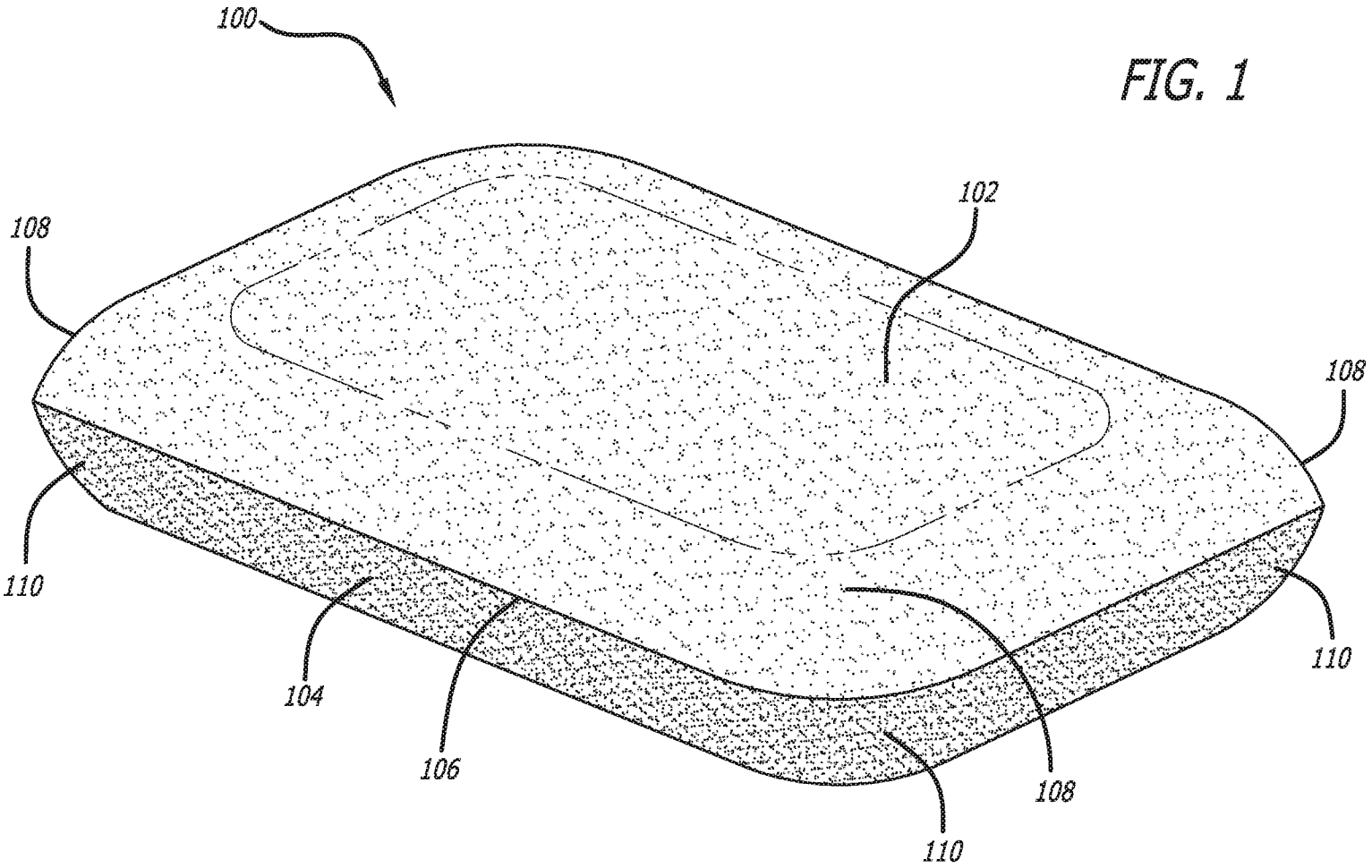
FIG. 1 is a top and side perspective view of one example of an implementation of a pillow of the present invention.
Figure 1A:
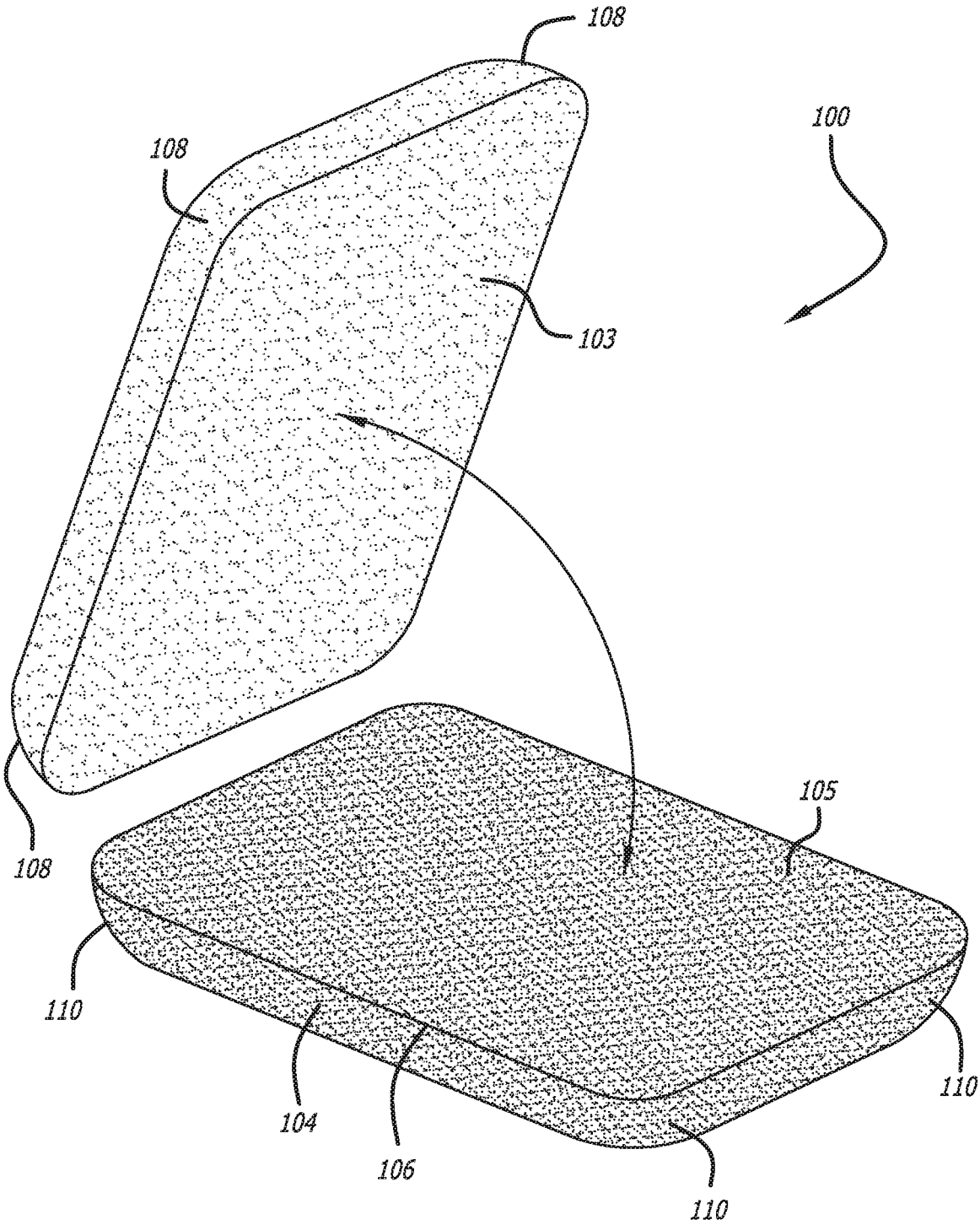
FIG. 1A side perspective view of one example of an implementation of a pillow of the present invention, illustrating the top and bottom portions of the pillow separated.

FIG. 1 is a top and side perspective view of one example of an implementation of a pillow 100 of the present invention. FIG. 1A is a side perspective view of one example of an implementation of a pillow of the present invention, illustrating the top and bottom portions of the pillow separated.

As illustrated by FIGS. 1 and 1A, the pillow 100 includes two halves, sections, portions, or pieces 102, 104 made of pillow material. If the pillow material is memory foam, the memory foam may be constructed from a polyurethane or viscoelastic foam (e.g. memory foam). Alternatively, sections 102, 104 may also be made of other pillow material such as fill and/or regular foam. As stated above, fill may include any loose material, included but not limited to natural fill (down, feathers or a combination of the two), synthetic fill (which are filled with a man-made fill, customarily polyester) and/or poly cluster fill pillows (which have a synthetic fill of polyester clusters coated with silicone to feel and move like down). Regular foam may comprise of one solid piece or chunk of foam. The pillow 100 may be of a standard shape, typically 26" in length, and 20" in width and 5" in thickness, which is the most common pillow size. However, the pillow may also be constructed of other sizes, including, for example, super standard pillows (e.g., 20"×28"), queen size pillows (20"×30" e.g.), king size pillows (e.g., 20"×36"), euro pillow sizes (16"-26"×16"-26"), body pillows (e.g., 48"-54"×20") or throw pillow, which can range anywhere from 8-24" in width and length.

Each section 102, 104 forms generally half of the upper and/or lower portion of the pillow 100. As will be explained further below, each section 102, 104 may comprise of the same or different pillow material density so that one side of pillow 100 is softer than the other. This allows the user to flip the pillow 100 over (by turning the top side toward the bottom) to change the firmness of the pillow 100 that the user's head contacts.

Each section 102, 104 of the pillow 100 has tapered edges 108, 110 along its length and width, respectively, giving it a dome-like shape. The bottoms 103, 105 of each section 102, 104 are generally flat. Both the top section 102 and bottom section 104 of the pillow 100 may be formed of different or similar pillow material having different or similar densities. For example, either section 102, 104 may comprise of pillow material having a density anywhere between 25-75 percent density by percentage of how dense the pillow material is or is packed. While different densities of pillow material may be used in sections 102, 104 to provide different firmness levels, it should be known that similar densities of pillow material may be used in sections 102, 104 that will provide different firmness levels depending on the type of pillow material that is used. For example, both the top and bottom sections 102, 104 may comprise of memory foam having the same density where the top section 102 may be firmer than the bottom section 104 due to the memory foam in the top section 102 comprising of a different memory foam composition than the memory foam composition in the bottom section 104. In another example, the top section 102 may comprise of regular foam and the bottom section 104 may comprise of fill such as feathers to provide different firmness levels to each section of the pillow 100. In another example, the top section 102 of the pillow 100 may be formed of memory foam having a density of between 36-55 or between 45-55 percent density by percentage of how dense the polyurethane foam is packed (with 50 percent being optimal), and the bottom section 104 of the pillow 100 is formed of memory foam having a density of between 36-55 or between 36-46 percent density by percentage of how dense the polyurethane foam is packed (with 40 percent being optimal). While generally the lower the density percentage the softer the pillow material, it should be noted that firmness level will also depend on the firmness of the pillow material itself, depth of the pillow material, the layers used in the pillow, and the ambient temperature (for temperature sensitive foams). Thus, as stated above, while the top section 102 of the pillow 100 may be formed of memory foam of the same density as the memory foam on the bottom section 104 of the pillow 100, the top section 102 may comprise of a firmer memory foam material than the bottom section 104. In this example, the top section 102 of the pillow 100 will be the firmer side, and the bottom section 104 of the pillow 100 will be the softer side. When this pillow 100 is turned over, the top section will become 104 and will be the softer side and the bottom section will become 102 and will be the firmer side.

In one example of an implementation of the invention, the flat bottoms 103, 105 of each of the two pieces 102, 104 of the pillow 100 are joined together in their entirety by adhesive, giving the exterior of the pillow 100 a central seam 106.

The pillow 100 may be formed by a molding process that seals the top portion 102 with the bottom portion 104. The molding process comprises the steps of forming one piece 102 of the pillow 100 having a predetermined density by: (1) pouring the liquid foam material into a machine capable of spraying the liquid; (2) spraying the liquid into a mold; (3) molding the material (e.g., allowing it to sit for five minutes); and (4) curing the material for a predetermined time period (e.g., 5 days). The process is repeated to form the second piece 104 of the pillow 100 having a different density than the first piece 102 by repeating steps 1-4 above. Then, the two pieces 102, 104 are glued together and cured for another predetermined amount of time (e.g., 2 days). Finally, the pillow 100 is covered and the finished product is packaged.

Figure 2:
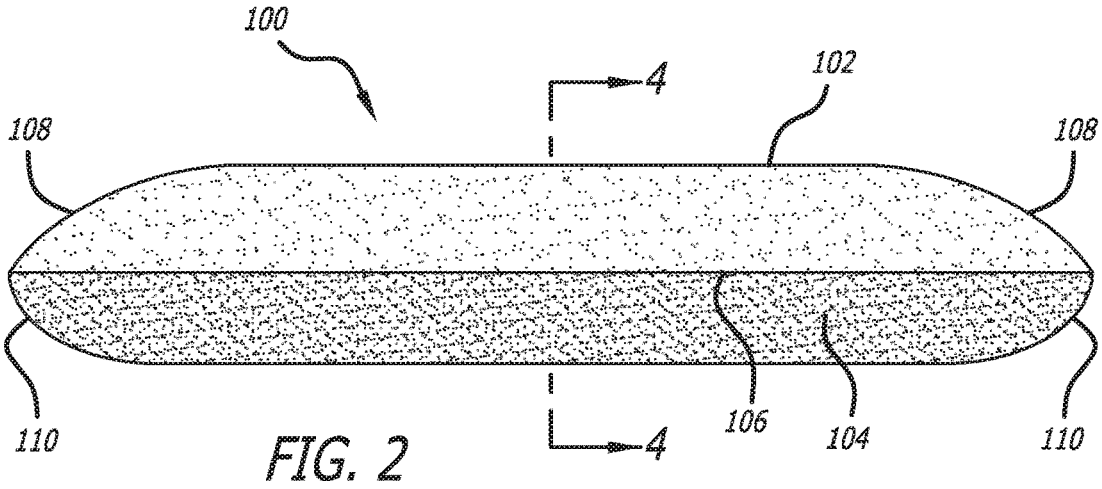
FIG. 2 is a lengthwise side perspective view of the pillow of FIG. 1.

FIG. 2 is a lengthwise side perspective view of the pillow of FIG. 1. FIG. 2 illustrates a lengthwise side perspective view of the pillow 100, showing the top piece 102 and the bottom piece 104 of the pillow 100 of different densities, the sloping sides 108, 110 of the pillow 100 and the central seam 106 formed by joining the two pieces 102, 104.

Figure 3:
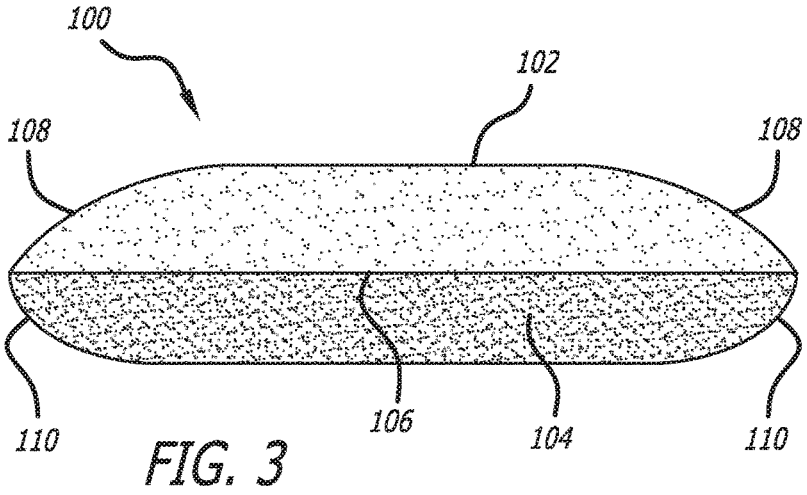
FIG. 3 is a widthwise side perspective view of the pillow of FIG. 1.

FIG. 3 is a widthwise side perspective view of the pillow 100 of FIG. 1. FIG. 3 illustrates a widthwise side perspective view of the pillow 100, showing the top piece 102 and the bottom piece 104 of the pillow 100 of different densities, the sloping sides 108, 110 of the pillow 100 and the central seam 106 formed by joining the two pieces 102, 104.

Figure 4:
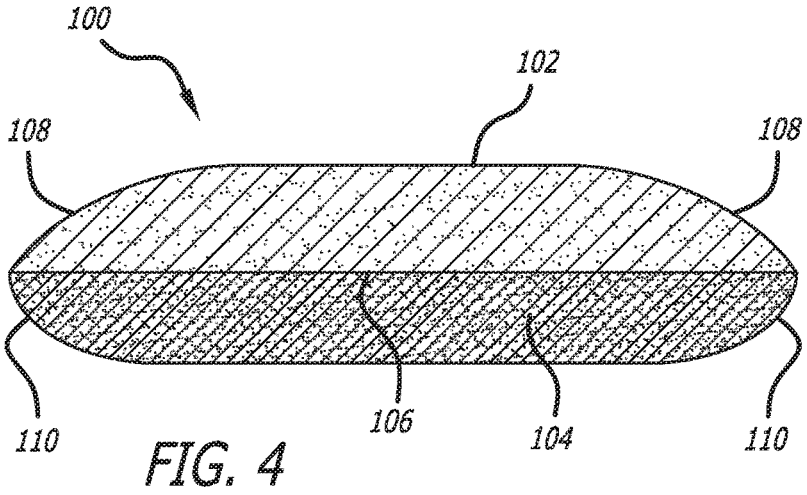
FIG. 4 is a cross section of the pillow of FIG. 2 taken along line 4-4 of FIG. 2.

FIG. 4 is a cross section of the pillow of FIG. 2 taken along line 4-4 of FIG. 2. FIG. 4 is a cross section view of the pillow 100 along the line 4-4 of FIG. 2, showing the top piece 102 and bottom piece 104 of the pillow 100 of different densities, the sloping sides 108, 110 of the pillow 100 and the central seam 106 formed by joining the two pieces 102, 104.

The unique densities of the top portion 102 and the bottom portion 104 of the pillow 100 are designed to provide improved sleep and other health benefits, such as orthopedic benefits, over prior known pillows. The firmer top piece 102 of the pillow 100 overlies the softer lower piece 104. In use, the cranial region of the sleeper subsides into the softer pillow material and is brought to rest by impinging against the softer side. The cranium is effectively and comfortably cradled in the concave indentation formed between the ends of different density of the top piece 102 and the bottom piece 104 of the pillow 100. Thus, the pillow 100 provides two different zones of support for the head and for the upper neck and spine: each zone has differing elasticity based on the density of the pillow material underlying that zone.

The choice and design of the top piece 102 and the bottom piece 104 of the pillow 100 may be made with a view to the modulus ("sag factor") of the pillow material, i.e. its ability to support weight with an ever-increasing resistance (force of reaction) so that the head does not bottom out. This consideration is of particular importance for supporting the head of a side-sleeper above the surface of the mattress.

The choice and design of the pillow material for the top piece 102 and the bottom piece 104 of the pillow 100 may be made with a view to fitting the pillow 100, in use, as closely as possible to suit the personal morphology of the sleeper.

The density of the pillow material of the top piece 102 and the bottom piece 104 of the pillow 100 may also be chosen independently of the choice of modulus or firmness.

In alternate examples, the pillow 100 may be varied as to its size and/or shape. It may be smaller than the standard size, such as a travel pillow, or larger, such as a body pillow. It may be round, square or crescent-shaped or otherwise molded to fit around the contours of a person's head, shoulders and/or body to improve comfort and support.

In addition, the shapes of the top piece 102 and the bottom piece 104 of the pillow 100 need not be identical as shown in FIG. 4. While FIG. 4 shows the shape of the top section 102 as a mirrored image of the shape of the bottom section 104, one of the pieces 102 or 104 could be larger than the other with sides that overlap the other piece, or vice versa. Moreover, the seam 106 between the two pieces 102, 104 created by the adjoining bottoms 103, 105 need not be a level plane. Both the seam 106 and/or the bottoms 103, 105 could be curved, undulating or of any other configuration.

Figure 5:
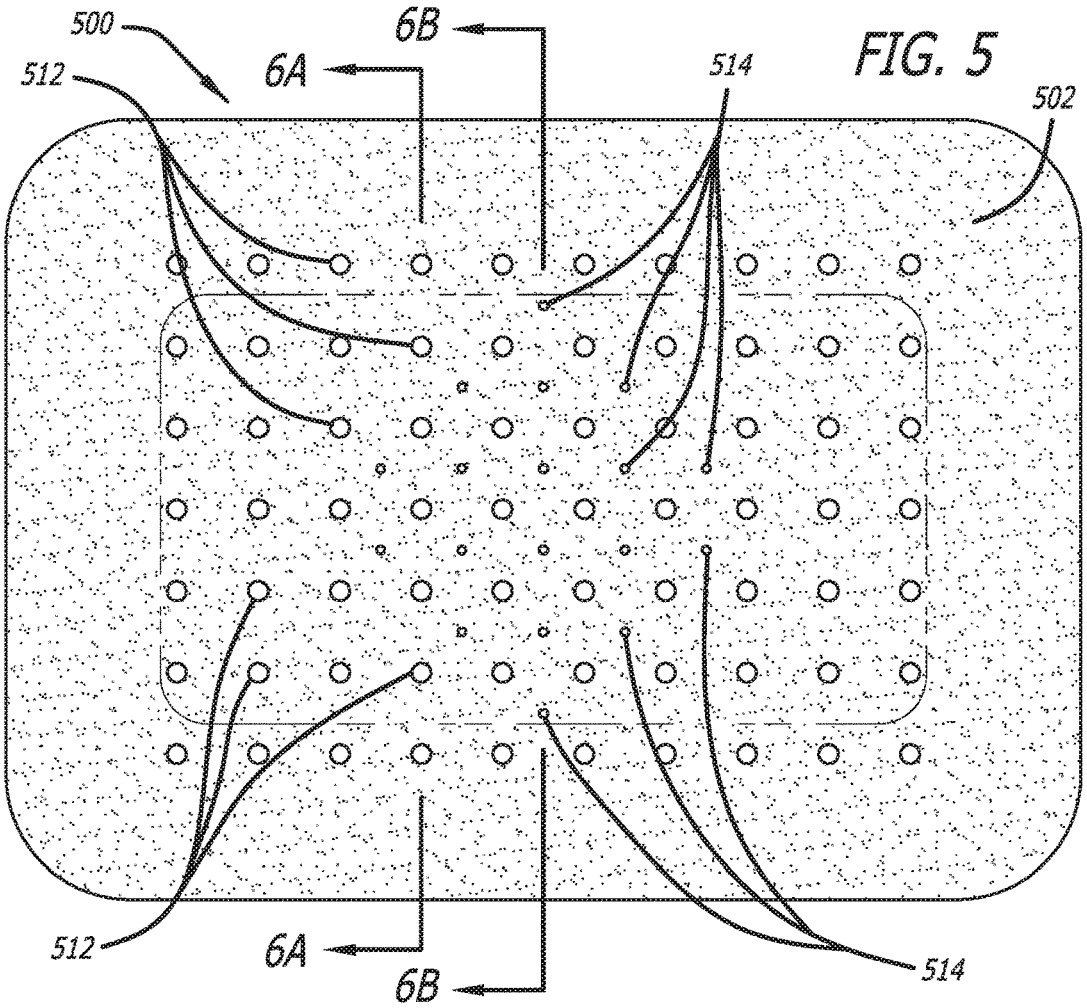
FIG. 5 is a top view of another example of an implementation of the present invention illustrating both large and small holes extending from the upper surface of the pillow to the lower surface of the pillow.

FIG. 5 is a top view of another example of an implementation of the present invention illustrating both large and small holes extending from the upper surface of the pillow to the lower surface of the pillow. An example of a pillow 500 with holes is provided in FIG. 5, which is a top view of one example of the present invention illustrating holes 512, 514 extending from the upper surface 502 of the pillow 500 to the lower surface 604 of the pillow 500. Due to the presence of holes 512, 514, the pillow material will preferably consist of regular foam or memory foam. While fill may still be used, those having skill in the art will recognize that the circumference of each hole 512, 514 extending through the entire pillow will need to be sealed so that no fill material will be able to escape. As seen in FIG. 5, holes 512, 514 of the same or varying diameters may be drilled through the pillow 500 extending from the top part 502 of the pillow 500 to the bottom part 604 of the pillow 500, as shown in FIGS. 6A and 6B, or may be drilled to extend only partially through the pillow 500 (e.g., in the solid foam portion when one side is fill), so as to allow the pillow material of the pillow 500 of the present invention to breathe, for purposes of aerating the pillow 500 and helping to maintain a lower body temperature of the user in contact with the pillow 500.

The holes 512, 514 in the pillow 500 may range in size from 1-15 mm (optimally between 4-10 mm) and may be placed across the pillow 500 in columns and rows or in any varying pattern. As shown in the example of FIG. 5, some of the holes 512 may be of larger diameter, and some of the holes 514 may be of smaller diameter. The smaller holes 514 may also be positioned to better allow the pillow to breathe. For example, as illustrated in FIG. 5, smaller holes 514 may be placed towards the center of the pillow 500 in addition to the larger holes 512. By placing the smaller holes 514 in between the larger holes 512 near the center of the pillow 500, further airflow is provided to the user at the approximate location of where the user's head would be placed on the pillow 500. It is recognized that the orientation, spacing, and location of the holes 512, 514 may have a variety of different configurations, and that FIG. 5 is but one example of the placement of holes 512, 514 in the pillow 500. The holes 512, 514 may, for example, be positioned at predetermined spaces equidistant from one another and may all be of the same size. The measurements shown in FIG. 5 are offered for illustration and are provided in millimeters (mm). Those skilled in the art will recognize that the size of the pillow 500, size of the holes 512, 514, and placement and position of the holes 512, 514 may vary without departing from the scope of the invention. For example, as shown in FIG. 5, the holes 512, 514 may be positioned such that the holes 512, 514 are located toward the center of the pillow, thus creating a border formed by the distance between the holes 512, 514 and the perimeter edge of the surface 502, 604 of the pillow 500. In particular, holes 512, 514 may be positioned such that no hole 512, 514 is located within at least 2.3 to 3.3 inches of the perimeter edge of the surface 502, 604 of the pillow.

Figure 6A:
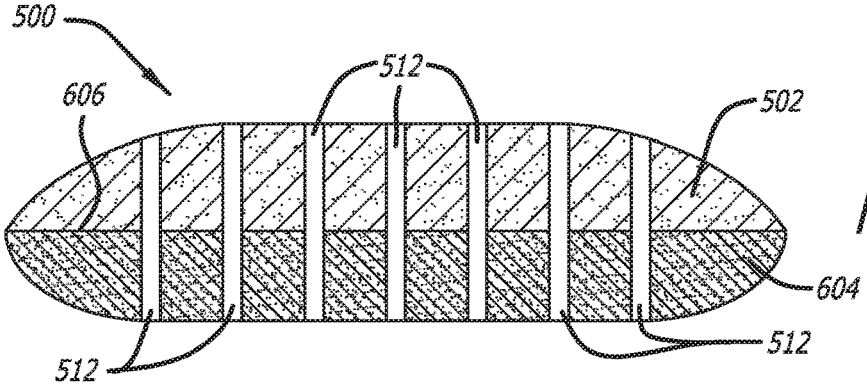
FIG. 6A is a cross section of the pillow of FIG. 5 taken along line 6A-6A of FIG. 5, illustrating the large holes extending from the upper surface of the pillow to the lower surface of the pillow.
Figure 6B:
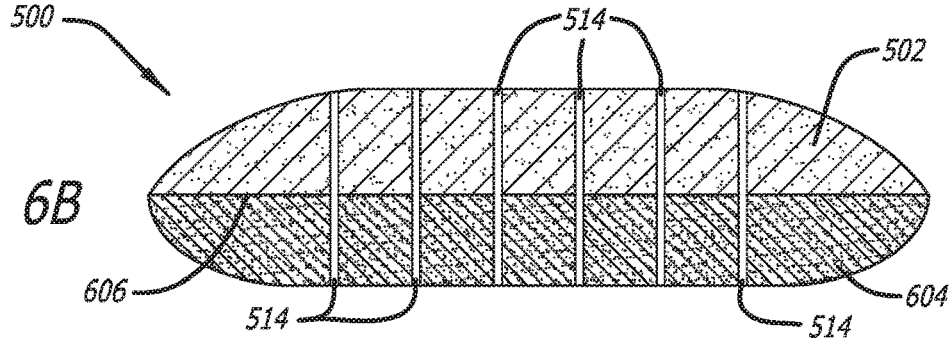
FIG. 6B is a cross section of the pillow of FIG. 5 taken along line 6B-6B of FIG. 5, illustrating the small holes extending from the upper surface of the pillow to the lower surface of the pillow.

FIG. 6A is a cross section view of one embodiment of the pillow 500 of the present invention along line 6A-6A of FIG. 5, illustrating the top part 502, bottom part 604, central seam 606, and larger holes 512 of the pillow 500 extending from the top part 502 to the lower part 604. FIG. 6B is a cross section view of one embodiment of the pillow 500 of the present invention along line 6B-6B of FIG. 5, illustrating the top part 502, bottom part 604, central seam 606 and smaller holes 514 of the pillow 500 extending from the top part 502 to the bottom part 604.

Figure 7:
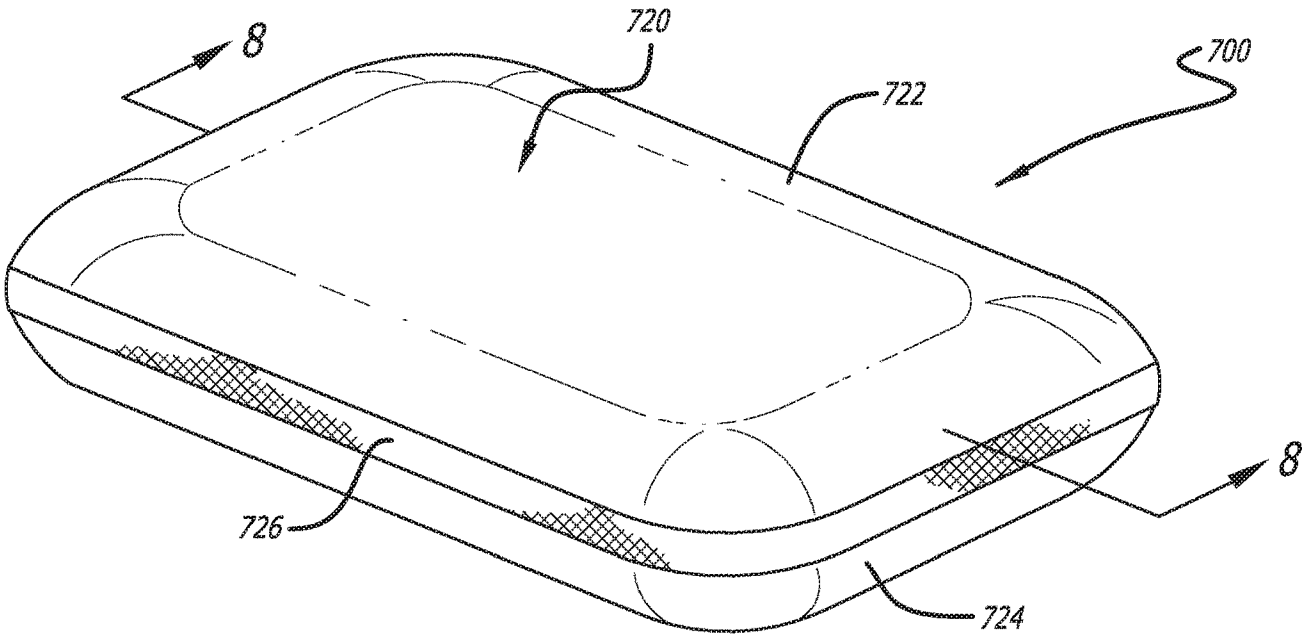
FIG. 7 illustrate a top perspective view of another implementation of the present invention illustrating a pillow with a gusseted covering.

As illustrated by FIG. 7, a pillow 700 either with or without holes may be covered with any covering 720. In the example illustrated by FIG. 7, the covering 720 may comprise a top layer 722 and bottom layer 724 joined around the sides of the pillow by a gusset 726. The top layer 722 and bottom layer 724 of the covering 720 and/or the gusset 726 may be formed either from breathable material, allowing air to pass through or non-breathable material. Various combinations of breathable and non-breathable material may be employed to create, for example, breathable top and bottom layers 722, 724 of the pillow covering 720 and a non-breathable gusset 726, non-breathable top and bottom layers 722, 724 of the pillow covering 720 and a breathable gusset 726, or breathable top and bottom layers 722, 724 of the pillow covering 720 and a breathable gusset 726.

Figure 8:
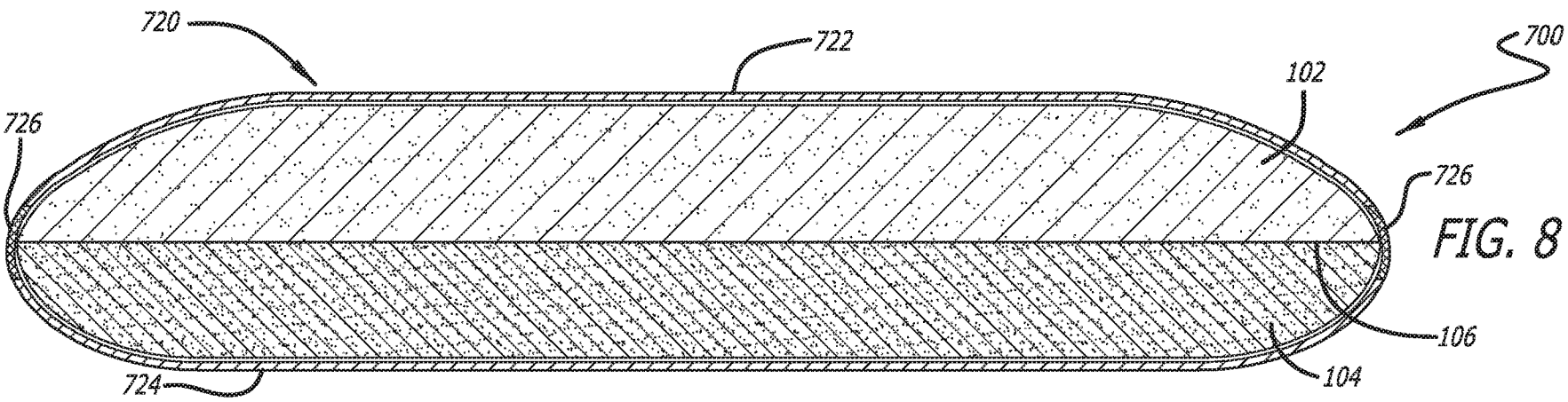
FIG. 8 is a cross section view of the pillow of FIG. 7 taken along line 8-8 of FIG. 7, illustrating the top, bottom and gusset of the gusseted covering encasing the pillow.

FIG. 8 shows a cross section view of the pillow 700 along line 8-8 of FIG. 7, showing the top part 102 of the pillow 700, the bottom part 104 of the pillow 700, the pillow cover 720, the top layer 722 of the pillow cover 720, the bottom layer 724 of the pillow covering 720 and the gusset 726.

Figure 9:
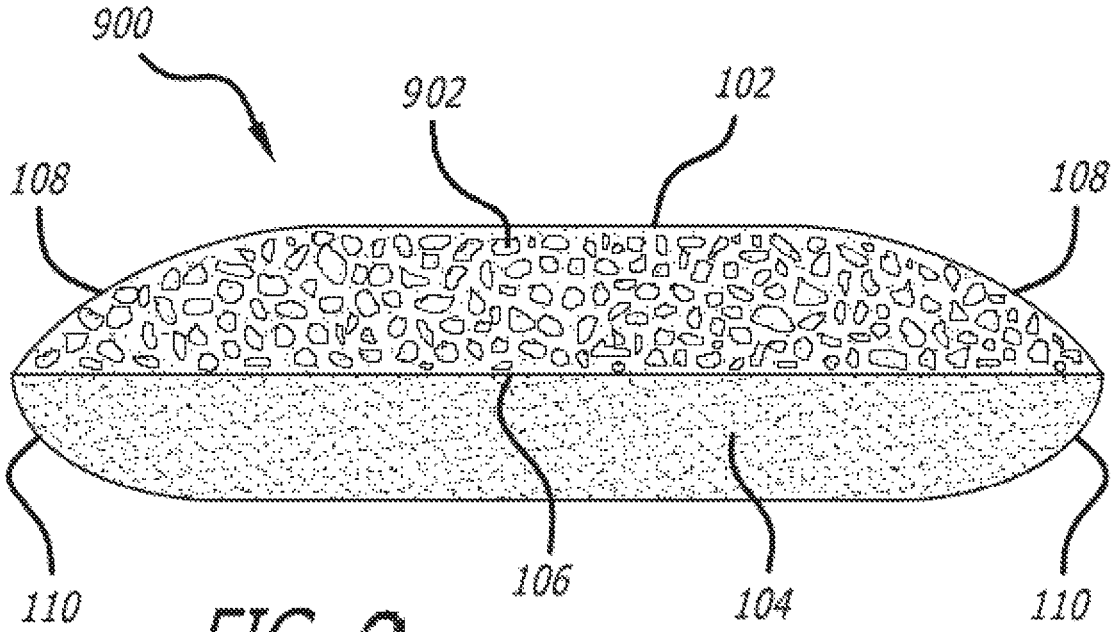
FIG. 9 is a cross section view of another example of an implementation of a pillow of the present invention.

FIG. 9 is a cross section of another example of an implementation of a pillow of the present invention. Similar to pillow 100, pillow 900 includes two halves, sections, portions, or pieces 102, 104 made of pillow material. As shown in FIG. 9, top section 102 may comprise of fill 902 while the bottom section 104 may comprise of regular foam or memory foam. The fill 902 may be made of any loose pillow material known in the art, including but not limited to down, feathers, regular foam pieces, memory foam pieces, man-made fill, synthetic fill, poly cluster, or custom polyester. The fill 902 may further comprise of any combination of loose pillow material. As further shown in FIG. 9, the fill can not only comprise of different material but can also comprise of different shapes, sizes or any combination thereof.

Figure 10:
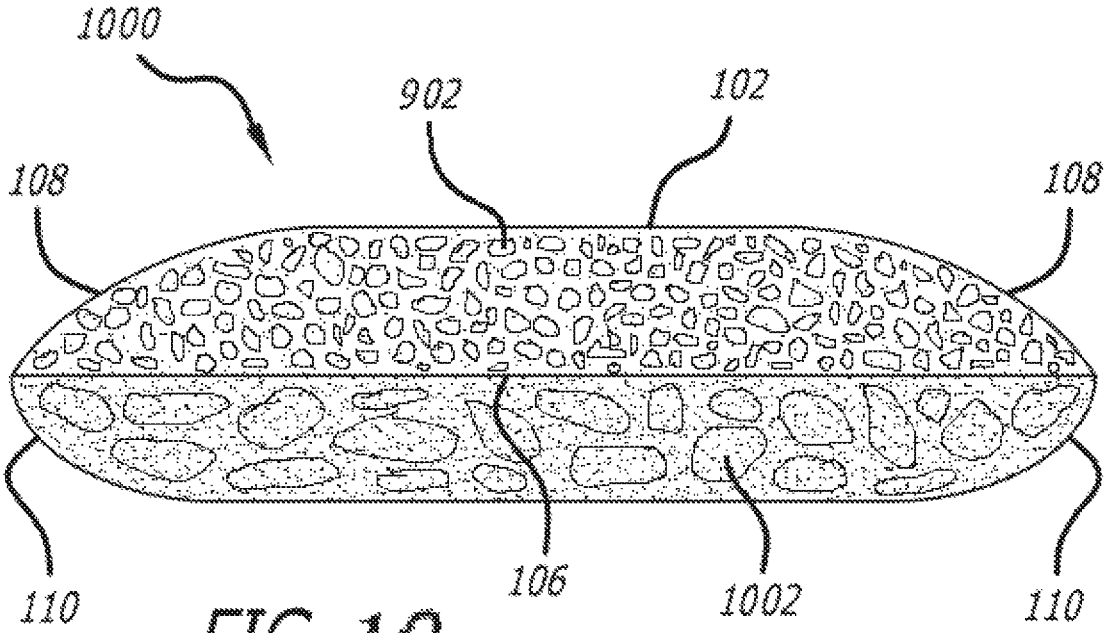
FIG. 10 is a cross section view of yet another example of an implementation of a pillow of the present invention.

FIG. 10 is a cross section view of yet another example of an implementation of a pillow of the present invention. Similar to pillow 100 and 900, pillow 1000 includes two halves, sections, portions, or pieces 102, 104 made of pillow material. As shown in FIG. 10, top section 102 may comprise of fill 902 while the bottom section 104 may comprise of different fill or similar fill of a different size and/or density 1002. For example, fill 902 and 1002 may comprise of the same loose material, different loose material, different size of loose material, different number of loose material pieces, or any combination thereof. For example, fill 902 may comprise of small feathers while fill 1002 may comprise of bigger feathers. In another example, fill 902 may comprise of regular foam pieces while fill 1002 may comprise of down. The fill may also be a combination of different materials, including, for example, both regular foam and memory foam.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A pillow having an upper surface, a lower surface and a perimeter edge, the pillow comprising two parts: a firmer lower part and a softer upper part, each part made from pillow material having a top surface with curved edges and a bottom surface, wherein the bottom surfaces of the firmer lower part and softer upper part are internally sealed together along the entirety of their surfaces to form a central seam, wherein the central seam runs parallel relative to the ground when the top surface of the firmer lower part lies flat on the ground, wherein a plurality of holes extend through the pillow from the upper surface of the pillow to the lower surface of the pillow, wherein the plurality of holes are positioned such that no hole is located within at least 2 inches of the perimeter edge of the upper and lower surface of the pillow, wherein the plurality of holes include both smaller holes and larger holes, and wherein the smaller holes are intermingled with the larger holes and consolidated nearer to the center of the pillow than the larger holes.

2. The pillow of claim 1, where the shape of the firmer lower part is a mirror image of the shape of the softer upper part when the bottom surfaces of the lower part and upper part are internally sealed together along the entirety of their surfaces.

3. The pillow of claim 1, where the firmer lower part has identical pillow material density as the pillow material density of the softer upper part.

4. The pillow of claim 1, where the firmer lower part has different pillow material density than the pillow material of the softer upper part.

5. The pillow of claim 1, where the firmer lower part is made from different pillow material than the pillow material of the softer upper part.

6. The pillow of claim 1, where the firmer lower part is made from the same pillow material as the softer upper part.

7. The pillow of claim 1 where the two parts, once sealed together, are covered by a covering, where the covering includes a top layer and bottom layer joined around the sides by a gusset.

8. The pillow of claim 1 where the firmer lower part and a softer upper part are made of memory foam.

9. The pillow of claim 1 where the bottom surfaces of the firmer lower part and softer upper part are generally flat.

10. The pillow of claim 1 where the firmer lower part is made from foam that is not memory foam and the softer upper part is made from memory foam.

11. A pillow having an upper surface, a lower surface and a perimeter edge, the pillow comprising two parts: a firmer lower part and a softer upper part each having an external and internal shape, each part made from viscoelastic foam material having a density and wherein each of the firmer lower and softer upper part has a top surface with curved edges and a generally flat bottom, which generally flat bottoms are internally sealed together along the entirety of their surfaces, wherein the external and internal shapes of the two parts when joined together at their bottoms are mirror images of one another, wherein a plurality of holes extend through the pillow from the upper surface of the pillow to the lower surface of the pillow wherein the plurality of holes include both smaller holes and larger holes, and wherein the smaller holes are intermingled with the larger holes and consolidated nearer to the center of the pillow than the larger holes.

12. The pillow of claim 11, where the two parts, once sealed together, are covered by a covering, where the covering includes a top layer and bottom layer joined around the sides by a gusset.

13. The pillow of claim 11, where the firmer lower part has identical pillow material density as the pillow material density of the softer upper part.

14. The pillow of claim 11, where the firmer lower part has different pillow material density than the pillow material density of the softer upper part.

15. The pillow of claim 11, where the firmer lower part is made from different pillow material than the pillow material of the softer upper part.

16. The pillow of claim 12 where the gusset is not breathable.

17. The pillow of claim 12 where the top layer and bottom layer of the covering are made of a breathable material allowing air to pass there through.

18. A pillow having an upper surface, a lower surface and a perimeter edge, the pillow comprising a first section and a second section, wherein the first and second sections are of different firmness levels and wherein each of the first and second sections are made from pillow material and wherein each of the first and second sections have a top surface having curved edges and a flat bottom surface, which bottom surfaces are internally sealed together and wherein the first section forms an upper half of the pillow and the second section forms the lower half of the pillow, where the two sections when joined together at their bottom surfaces are mirror images of one another, wherein a plurality of holes extend through the pillow from the upper surface of the pillow to the lower surface of the pillow wherein the plurality of holes include both smaller holes and larger holes, and wherein the smaller holes are intermingled with the larger holes and consolidated nearer to the center of the pillow than the larger holes.

19. The pillow of claim 18 where the bottom surfaces of the first and second sections are internally sealed together along the entirety of their surfaces.

20. The pillow of claim 18, where the pillow material is selected from the group consisting of memory foam, foam that is not memory foam, and fill.

21. A pillow comprising two halves that include an upper half and lower half each having an external and internal shape, where the upper half and lower half have generally flat top surfaces with curved edges with generally flat bottoms and are joined together at their bottoms, the external and internal shapes of the two halves when joined together at their bottoms are mirror images of one another and are each made from a foam material where one half of the two halves is firmer than the other half and where the pillow includes a plurality of holes that extend from the upper surface of the pillow through the bottom surface of the pillow, wherein the plurality of holes include both smaller holes and larger holes wherein the smaller holes are intermingled with the larger holes and consolidated nearer to the center of the pillow than the larger holes.

22. The pillow of claim 21, where the pillow material is memory foam and where the upper half is made from a different pillow material density than the pillow material density of the lower half.

* * * * *